US005497817A

United States Patent [19]

Ikegami

[11] Patent Number: 5,497,817

[45] Date of Patent: Mar. 12, 1996

[54] METHOD FOR CONTINUOUSLY ANNEALING STEEL STRIP

[75] Inventor: Hiroshi Ikegami, Futtsu, Japan

[73] Assignee: Nippon Steel Corporation, Tokyo, Japan

[21] Appl. No.: 369,340

[22] Filed: Jan. 6, 1995

Related U.S. Application Data

[62] Division of Ser. No. 185,825, filed as PCT/JP93/00633, May 13, 1993, abandoned.

[30] Foreign Application Priority Data

May 25, 1992 [JP] Japan ..... 4-156243

[51] Int. Cl.[6] ..... C21D 11/00

[52] U.S. Cl. ..... 148/500; 148/657; 148/661

[58] Field of Search ..... 266/103, 102; 148/657, 661, 500

[56] References Cited

U.S. PATENT DOCUMENTS 4,878,961 11/1989 Yamaguchi et al. ..... 148/657

FOREIGN PATENT DOCUMENTS 56-65942 6/1981 Japan .
56-163224 12/1981 Japan .
59-43979 10/1984 Japan .
3-173721 7/1991 Japan .

*Primary Examiner*—Scott Kastler
*Attorney, Agent, or Firm*—Wenderoth, Lind & Ponack

[57] ABSTRACT

In an apparatus for continuously annealing a steel strip after cold rolling, stable operation of the annealing apparatus can be obtained by preventing slippage of bridle rolls and hearth rolls. The diameter D of a bridle roll is set so that a surface pressure p defined by an equation $p=h(\sigma_1+\sigma_2)/D$ can be 10 kPa (kilopascal) or more, wherein the unit tension of a steel strip at the inlet side of the bridle roll and hearth rolls of the apparatus is $\sigma_1$, the unit tension at the outlet side is $\sigma_2$, the thickness of the steel strip is h and the diameter of the bridle roll is D.

3 Claims, 2 Drawing Sheets

METHOD FOR CONTINUOUSLY ANNEALING STEEL STRIP

This application is a division of now abandoned application, Ser. No. 08/185,825, filed as PCT/JP93/00633, May 13, 1993.

BACKGROUND OF THE INVENTION

The present invention relates to an apparatus and method for continuously annealing a steel strip after cold rolling, wherein the term "steel strip" refers to steel products ultimately applicable to production of cans, steel furniture, automobiles, etc. after continuous annealing, and, if necessary, tin plating, zinc plating, etc.

Generally, on one hand, the higher the tension of a steel strip in a furnace of an apparatus for continuous annealing, the better from the viewpoint of preventing walk or fluttering, and on the other hand, the lower the tension, the better from the viewpoint of preventing heat buckling.

To satisfy such contrasting requirements, it is an ordinary operating practice to decrease the tension of steel strip in a heating furnace or a soaking furnace where the steel strip is at a relatively high temperature and increase the tension in a cooling furnace or an overaging furnace where the steel strip is at a relatively low temperature.

Such tension distribution can be obtained by finely adjusting and controlling a hearth roll speed, and when it is desired to change the tension radically at a position in the furnace, it is an ordinary practice to provide a bridle roll in the furnace.

FIG. 1 shows one example of that practice, where sets of hearth rolls 3 are so arranged in the individual furnaces as to guide a steel strip 1 into the individual furnaces from the inlet side to the outlet side and a set of bridle rolls 2 is arranged just before a rapid cooling (or quenching) furnace 6 in which the steel strip 1 that has passed through a heating furnace 4 and a soaking pit 5 is to be exposed to a gas jet stream of a high speed, and the tension of the steel strip 1 becomes largest after passing through the set of bridle rolls 2. Then, the steel strip 1 passes through the successive quenching furnace 6, an overaging furnace 7 and a final cooling furnace 8 under the largest tension.

The set of bridle rolls 2 and sets of hearth rolls 3 provided for these purposes must reliably restrict the steel strip 1 so as to prevent any slip. Actually, the bridle rolls 2 and hearth rolls 3 have often slipped, particularly when the thickness of the steel strip is small, and have failed to perform their proper functions.

An object of the present invention is to solve these problems and to provide an apparatus for continuously annealing a steel strip, capable of performing functions of bridle rolls and hearth rolls satisfactorily so as to attain a stable operation of the apparatus for annealing.

SUMMARY OF THE INVENTION

To solve the above-mentioned problems, the present invention provides apparatus and a method given in the following items (1) to (6):

(1) An apparatus for continuously annealing a steel strip, which comprises furnaces and sets of rolls so arranged in the furnaces as to guide a steel strip fed into the furnaces from the inlet side to the outlet side, at least one roll of the sets of rolls having such a diameter D as to make a surface pressure p defined by the following equation (I) 10 kPa (kilopascal) or more:

$$P=h(\sigma 1+\sigma 2)/D \quad \text{(I)}$$

wherein the unit tension of the steel strip at the inlet side of the roll is σ1, the unit tension at the outlet side of the roll is σ2, the thickness of the steel strip is h and the diameter of the roll is D.

(2) An apparatus as described in the above-mentioned item (1), wherein at least one roll of the sets of rolls is a bridle roll.

(3) An apparatus as described in the above-mentioned item (1), wherein at least one roll of the sets of rolls is a hearth roll.

(4) An apparatus for continuously annealing a steel strip, which comprises furnaces and sets of rolls so arranged in the furnaces as to guide a steel strip fed into the furnaces from the inlet side to the outlet side, at least one roll of the sets of rolls being a bridle roll having such a diameter D as to make a surface pressure p defined by the following equation (I) 10 kPa (kilopascal) or more:

$$P=h(\sigma 1+\sigma 2)/D \quad \text{(I)}$$

wherein the unit tension of the steel strip at the inlet side of each bridle roll is σ1, the unit tension at the outlet side of the each bridle roll is σ2, the thickness of the steel strip is h and the diameter of the bridle roll is D.

(5) An apparatus for continuously annealing a steel strip, which comprises furnaces and sets of rolls so arranged in the furnaces as to guide a steel strip fed into the furnaces from the inlet side to the outlet side, at least one roll of the sets of rolls being a hearth roll having such a diameter D as to make a surface pressure p defined by the following equation (I) 10 kPa (kilopascal) or more:

$$P=h(\sigma 1+\sigma 2)/D \quad \text{(I)}$$

wherein the unit tension of the steel strip at the inlet side of the hearth roll is σ1, the unit tension at the outlet side of the hearth roll is σ2, the thickness of the steel strip is h and the diameter of the hearth roll is D.

(6) A system comprising: a plurality of furnaces operatively coupled together to form a continuous annealing furnace having an inlet and an outlet; a plurality of rolls rotatably mounted in the annealing furnace for feeding a steel strip of thickness h from the inlet to the outlet of the annealing furnace; wherein one of the rolls has a diameter D which causes the one of the rolls to constitute a means for causing the steel strip of thickness h to press against the one of the rolls with a surface pressure of at least 10 kPa, to thereby prevent slippage of the steel strip of thickness h relative to the one of the rolls; and wherein when the steel strip of thickness h is under an inlet tension $\sigma_1$ at an inlet side of the one of the rolls and an outlet tension $\sigma_2$ at an outlet side of the one of the rolls, the diameter D of the one of the rolls satisfies the following equation:

$$10kPa \leqq h(\sigma_1\sigma_2)/D.$$

A maximum tension T2 that cannot generate any slip technologically can be given by the following equation (II):

$$T2=T1\cdot exp(\mu\theta) \quad \text{(II)}$$

wherein the tension at the inlet side of the bridle rolls 2 is T1, the tension at the outlet side is T2, winding angles of a steel strip 1 around bridle rolls 2*a*, 2*b* and 2*c* are θ1, θ2 and θ3, respectively, the sum total (θ1+θ2+θ3) is θ, and the coefficient of friction is μ, as shown in FIG. 2.

In other words, the tension ratio T2/T1 depends solely upon parameter μθ and is independent of the absolute values of the tensions. However, the actual bridle rolls in the apparatus are liable to undergo slip when the absolute values of the tensions become smaller even in the same tension ratios. That is, it seems that the coefficient of friction μ is susceptible to tensions.

The number of bridle rolls is not limited, and just a single bridle roll will do. The number of bridle rolls can be determined from θ derived by inverse operation of the equation (II).

As a result of measuring the coefficient of friction at slip generation limits of hearth rolls and bridle rolls having different diameters in an actual apparatus for continuous annealing, it has been found that the coefficient of friction is a function of surface pressure p given by the following equation (III).

$$p=(T1+T2)/(DW) \quad \text{(III)}$$

wherein the diameter of a bridle roll is D and the width of a steel strip is W, as shown in FIG. 3.

An important fact is, as is apparent from FIG. 3, that the critical point of the coefficient of friction is at a surface pressure p of about 10 kPa (the surface pressure at this critical point will be hereinafter called a critical surface pressure pc).

When the surface pressure is at or above pc, the bridle rolls and the hearth rolls are normally effective to restrict a steel strip, whereas when the surface pressure is below pc they will slip, that is, the friction is kinetic friction. In order to make the bridle rolls and hearth rolls function normally, their diameters must be so set that the surface pressure can be at or above pc.

Generally, the object of hearth rolls is to convey a steel strip without changing tensions on the steel strip. The present inventor has found that the friction is in a state of kinetic friction below a surface pressure of 10 kPa, as is apparent from FIG. 3, and a slip occurs even due a slight difference in the tension between the inlet side and the outlet side of a hearth roll. The slip phenomenon, which appears even if there is no substantial difference in the tension, seems surprising. However, since the control unit for motors driving the hearth rolls generally has no means for detecting a true travelling speed of the steel strip, the roll peripheral speed is controlled to an instructed value (same as the peripheral speed of a bridle roll), and thus such a phenomenon seems to appear. Furthermore, the roll peripheral speed is not controlled as instructed, because the hearth roll diameter thermally expanded in the furnace at an elevated temperature cannot be detected exactly, and thus this fact also promotes the appearance of such a phenomenon. The slip presence leads to generation of defects in the steel strip, or buildups (fixation of iron component in the form of small spherical projections that also leads to defects in the steel strip) on the surface of hearth roll due to continued slip. These problems can be solved by selecting roll diameters appropriate to provide a surface pressure equal to or above a critical surface pressure according to the present invention.

Normal operation is so carried out that the unit tension σ of a steel strip can be kept constant, and thus the equation (III) can be given as the following equation (IV), when a correlation of tension T=σhW is used in the equation (III):

$$p=h(\sigma 1+\sigma 2)/D \quad \text{(IV)}$$

DETAILED DESCRIPTION OF THE INVENTION

EXAMPLE 1

One design example of bridle rolls based on the above-mentioned findings will be given below.

Under the following conditions, i.e. the unit tension of a steel strip at the inlet side of the bridle roll σ1=0.7 kg/mm$^2$, the unit tension at the outlet side σ2=1.2 kg/mm$^2$, the thickness of the steel strip h=0.25 mm, the number of rolls=3, the winding angle of the steel strip around the respective rolls= 180° and the tension ratio at the respective rolls is constant (=σ2/σ1=1.2), a critical surface pressure pc=10 kPa is inserted into the equation (IV) to obtain D1, D2 and D3. The results are D1=390 mm, D2=460 mm and D3=550 mm.

Actual differences in the roll diameter result in a complexity in their manufacture and maintenance, and all roll diameters are set at a constant 390 mm or less in view of safety.

Figure 1:
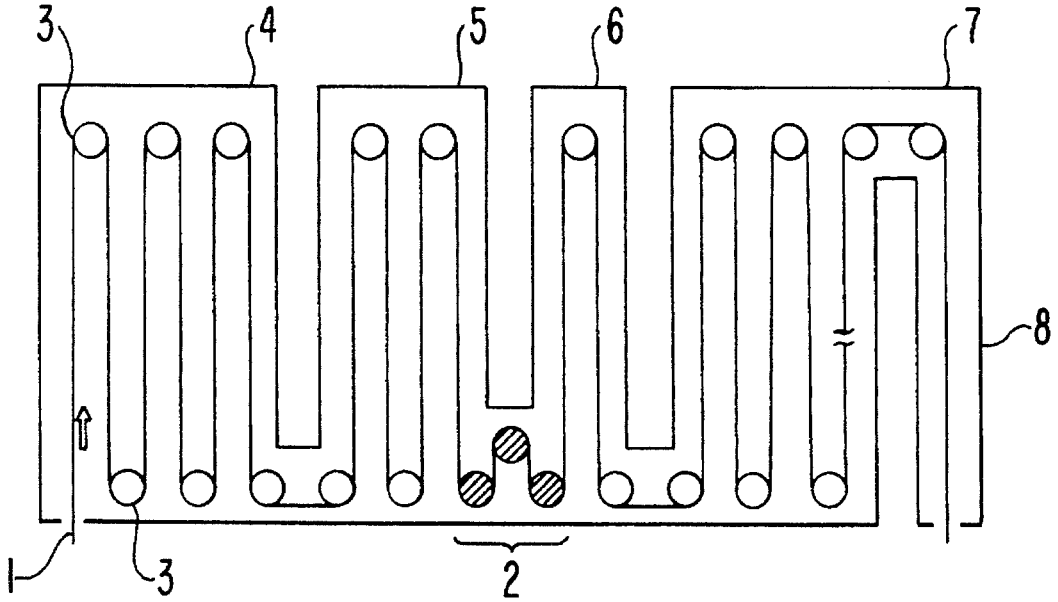
FIG. 1 is a schematic side view showing an arrangement of bridle rolls and hearth rolls in furnaces according to the present invention.
Figure 2:
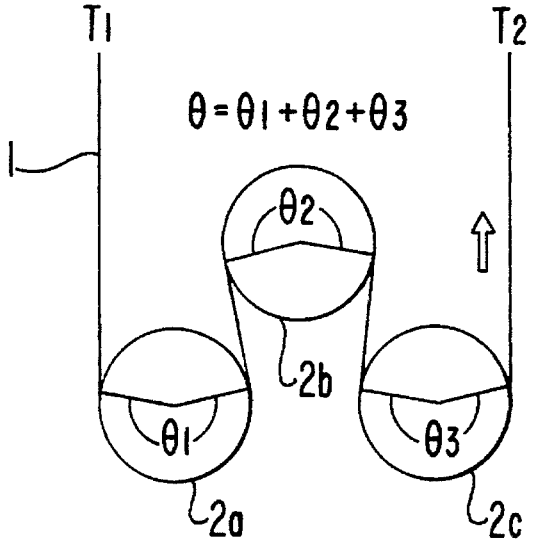
FIG. 2 is a diagram illustrating a general relationship between the winding angles and tensions of a steel strip around bridle rolls.
Figure 3:
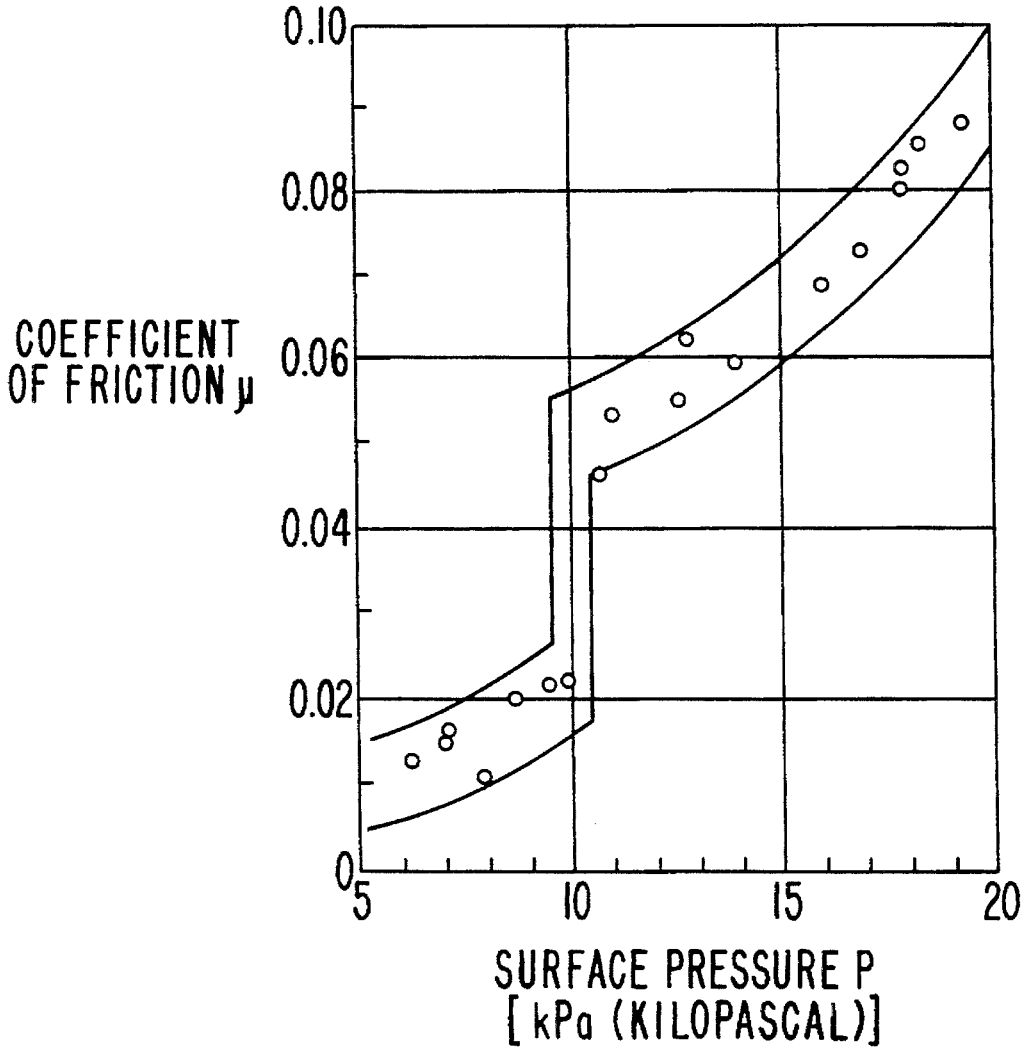
FIG. 3 is a diagram showing actual measurements of relationship between a surface pressure and coefficient of friction of bridle rolls and hearth rolls as basic data for the present invention.

Data shown in FIG. 3 relate to smoothly finished bridle rolls and hearth rolls, each made of steel, and are those obtained at a line speed of 350 to 600 mpm.

EXAMPLE 2

One design example of hearth rolls based on the above-mentioned findings will be given below.

Tensions of a steel strip at the inlet side and the outlet side of the hearth rolls are generally constant (σ1=σ2), and the equation (IV) can be applied to the hearth rolls as conditions for preventing slip occurrence in the same manner as in the case of bridle rolls.

Under the conditions of σ1=σ2=0.7 kg/mm$^2$, and the thickness of the steel strip h=0.25 mm, roll diameters D will be 350 mm or less.

When the surface finishing roughness of the bridle rolls or hearth rolls or the line speed considerably differs, there is a possibility for a change in the critical surface pressure pc defined by FIG. 3, but there is no change in the basic concept of setting the bridle roll diameter or the hearth roll diameter to result in a surface pressure at or above the critical surface pressure.

The concept of selecting roll diameters so that the surface pressure p can be at least such a critical value so as to avoid slippage can be applied not only to the bridle rolls, but also to all the hearth rolls, as mentioned above. Thus, at least one of the rolls in the annealing furnace (i.e., either a hearth roll or a bridle roll) is selected to have a diameter D such that the surface pressure (i.e., the pressure of the steel strip against that roll) p, wherein $p=h(\sigma_1+\sigma_2)/D$, is 10 kPa or more. That is, the at least one roll is selected to have a diameter D which satisfies the equation:

$$10\ kPa \leqq h(\sigma_1+\sigma_2)/D.$$

When the hearth roll diameter cannot be reduced due to the dimensional limits of the apparatus, as in a heating furnace provided with radiant tubes, attention must be paid to the design and adjustment of the hearth roll control system so as to avoid applying a driving force in excess of the necessary torque to the conveying of a steel strip by the hearth rolls. For example, speed instructions common to the furnaces must be limited so as to avoid causing an error in the speed over a predetermined value (a few mpm). The present invention also seems to provide appropriate suspending characteristics, etc.

As described above, bridle rolls and hearth rolls arranged in the apparatus for continuous annealing can provide a reliable tension-amplifying action to a steel strip as their proper function according to the present invention, thereby attaining a high level, stable operation in the apparatus for continuously annealing the steel strip, and also preventing serious defects such as occurrence of defects (flaws) due to slippage between the steel strip and the rolls.

We claim:

1. A method of continuously annealing a steel strip of a given thickness h, comprising the steps of:

providing a plurality of furnaces operatively coupled together to form a continuous annealing furnace having an inlet and an outlet;

providing a plurality of rolls in said annealing furnace for guiding the steel strip from the inlet to the outlet;

feeding the steel strip around said rolls in said annealing furnace such that the steel strip has a given inlet tension $\sigma_1$ at an inlet side of one of said rolls and a given outlet tension $\sigma_2$ at an outlet side of said one of said rolls;

wherein, in providing said plurality of rolls, said one of said plurality of rolls is selected to have a diameter D which satisfies the equation $$10\ kPa \leqq h(\sigma_1+\sigma_2)D,$$

to thereby cause the steel strip to press against said one of said rolls with a surface pressure of at least 10 kPa, so as to thereby prevent longitudinal slippage of the steel strip of thickness h relative to said one of said rolls.

2. A method as recited in claim 1, wherein in said step of providing said plurality of rolls, a set of bridle rolls is provided, and said one of said rolls comprises one of said bridle rolls.

3. A method as recited in claim 1, wherein in said step of providing said plurality of rolls, a set of hearth rolls is provided, and said one of said rolls comprises one of said hearth rolls.

* * * * *

UNITED STATES PATENT AND TRADEMARK OFFICE

CERTIFICATE OF CORRECTION

PATENT NO. : 5,497,817

DATED : March 12, 1996

INVENTOR(S) : Hiroshi IKEGAMI

It is certified that error appears in the above-identified patent and that said Letters Patent is hereby corrected as shown below:

Claim 1, column 6, line 10, change "$10kPa \leqq h(\delta_1+\delta_2)D$" to --$10kPa \leq h(\delta_1+\delta_2)/D$--.

Signed and Sealed this

Twenty-ninth Day of June, 1999

*Attest:*

Q. TODD DICKINSON

*Attesting Officer*

*Acting Commissioner of Patents and Trademarks*